United States Patent [19]

Litterst

[11] Patent Number: 4,558,207

[45] Date of Patent: Dec. 10, 1985

[54] ELECTRIC FLUID HEATER HAVING COMBINED HEATING AND FLOW CONTROL MECHANISM

[76] Inventor: Ralph S. Litterst, 721 Mira Vista Dr., SE., Huntsville, Ala. 35802

[21] Appl. No.: 637,981

[22] Filed: Aug. 3, 1984

Related U.S. Application Data

[63] Continuation-in-part of Ser. No. 394,318, Jul. 1, 1982, abandoned.

[51] Int. Cl.[4] ..... H05B 1/02; F24H 1/20; H01H 9/06

[52] U.S. Cl. ..... 219/308; 200/61.86; 219/304; 219/305; 219/306; 219/328; 219/515; 337/1

[58] Field of Search ..... 219/296–309, 219/327–331, 515; 200/61.86; 337/1

[56] References Cited

U.S. PATENT DOCUMENTS

| | | | |
|---|---|---|---|
| 1,196,487 | 8/1916 | Simon | 219/309 |
| 1,569,485 | 1/1926 | Hanson | 219/309 |
| 1,692,321 | 11/1928 | Zisch | 219/309 |
| 2,708,231 | 5/1955 | Tipping | 219/309 |
| 3,348,019 | 10/1967 | Miller et al. | 219/306 |
| 3,527,922 | 9/1970 | Reich et al. | 219/308 |

*Primary Examiner*—A. Bartis

*Attorney, Agent, or Firm*—Leonard Bloom

[57] ABSTRACT

An apparatus for heating and controlling the flow rate of a fluid which includes a fluid inlet, a chamber communicating therewith, an outlet operatively associated with the chamber and an electric resistance heating element within the chamber provided with appropriate controls so as to selectively and in a controlled manner heat the fluid passing therethrough. A control knob is associated with the device. Respective movements of the control knob control respectively the flow rate and the heating current to the heating element so that a single knob provides either heated or unheated fluid at an outlet. The electrical input to the heating element is controlled by a thermostat, which includes a bimetallic strip. A linkage may be moved by the control knob to, in effect, prevent the bimetallic strip from assuming its circuit-closing orientation even when the temperature of the fluid is low.

12 Claims, 2 Drawing Figures

ELECTRIC FLUID HEATER HAVING COMBINED HEATING AND FLOW CONTROL MECHANISM

This application is a continuation-in-part of the copending U.S. patent application Ser. No. 394,318 entitled "MINUMUM ENERGY HEATING AND FLOW CONTROL DEVICE" of Ralph S. Litterst filed on July 1, 1982, and now abandoned the disclosure of which is incorporated herein in its entirety by reference.

BACKGROUND OF THE INVENTION

This invention relates generally to devices for heating fluid and controlling its rate of flow and, more particularly, to such a device which includes a faucet.

Virtually every occupied static structure includes appropriate plumbing and conduit passageways to distribute both hot and cold water to various parts of the structure in response to demand and use requirements of the occupants. In conventional systems, ambient water is heated and stored at a central location in a holding tank, and thereafter, upon demand, this heated water is directed to appropriate outlets or faucets at various remote locations within the structure. This, of course, requires a parallel companion line which carries the cold water so that in use and operation two faucets with respective valves are required to effect blending. Consequently, it is frequently necessary to purge the line of water which has been standing from the hot-water faucet outlet to the central holding tank because the requisite heated temperature has been lost as a function of time. The concomitant waste of energy is more significant now in the United States than at any previous time because of the increasing cost of fuel and energy. Furthermore, the central heating location requires that energy in the form of heat be generated and put into this system regardless of demand or peak hour loads. The additional heating is required even when no user has drawn hot water from the system. Moreover, it is clear that demand can exceed the capacity of such a conventional system to provide hot water. In such prior art systems, heat will be supplied even when hot water is not called for by a user.

In an attempt to address the above-noted disadvantages and shortcomings, a number of known techniques have been proposed. The state of the art of which applicant is aware is represented by U.S. Patent Specifications identified as follows:

| | | | |
|---|---|---|---|
| 1,569,485 | Hanson | 2,708,231 | Tipping |
| 1,606,500 | Bodman | 2,843,717 | Tracy |
| 1,692,321 | Zisch | 3,348,019 | Miller et al. |
| 2,556,557 | Schweitzer, Jr. | 3,672,444 | Lowe. |

The patent to Hanson discloses a known prior art arrangement in which a valve mechanism includes an electrical heating element for heating the liquid which passes therethrough. A valve is adapted to alter the flow rate of a liquid from an inlet to an outlet. An electrical resistor heating element is operatively connected to a switch which energizes the electrical heating circuit. The fluid flow rate setting mechanism and the heating mechanism are separate devices. More specifically, the valve is a push-button rod movable axially to fixed open positions. No continuous flow adjustment is offered. A rotary lever swings between two alternate fixed positions against pins. The lever cannot be switched between cold and hot selector positions without allowing the valve to close, thus requiring repeated depressions of the push-button rod. The arrangement of Hanson has an awkward, multiple-manipulation mode of operation with limited facility of function.

Similarly, the patent to Zisch discloses a known prior art apparatus in which an electric water heater is required. A partial rotation of a shaft by manipulation of a handle does not energize an electrical heating element actuated by a switch; consequently, water can pass through the chamber without being heated. However, further rotation of the handle closes the circuit resulting in heating the water. Clearly, heating is not independently controllable but is a fixed function possible only when water is flowing. The apparatus is a portable unit attachable to any "bib cock" and requires separately located external electrical connections. The apparatus of Zisch can be viewed as having disadvantages and shortcomings similar to those of the arrangement of Hanson.

The patent to Tracy discloses another known prior art apparatus in which a similar type of water tap heater includes a heating chamber, a water flow control valve and a heat control means. The apparatus includes a separate thermostat for controlling the temperature of the water and a fusible link to serve as an override should the theremostat fail, thereby disabling the heating element. The apparatus can be viewed as a water heater; no flow control function is contemplated. The apparatus is a remotely located heater, as opposed to a centrally located water heater, proximate to the point of use, but is in no way integrated with a faucet or the like. Minimum pressure required to move a valve stem is likely to induce chatter at low flow rates. The thermostat location on an outlet results in delayed sensing of water temperature in the heating chamber at low rates. Parallel heating tubes are subject to hot spots, if not balanced, as to flow rates and heat input.

The patent of Tipping teaches the use of a known prior art electric water heater in which the water pressure, which occurs when the valve is open, actuates an electrical switch associated with a bellows for providing electric heating. The device uses a small reservoir to heat by convection. The device is large, over twelve inches in length, and very cumbersome for use at a sink faucet. At best, it could be located only in the vicinity of a sink faucet. No direct heat-limiting control is used; only pressure sensing of the water supply provides control. No heating on/off control is provided.

The remaining above-mentioned U.S. patent specifications disclose the state of the art further and diverge further from the relevant point of novelty of the present invention, as set forth hereinafter. For example, in the apparatus disclosed in the patent to Schweitzer, Jr., heat is applied only indirectly by heating of valve parts, the heating is not to control temperature but only viscosity of fluid, specifically in deep oil wells.

In the patent to Bodman, the device disclosed simply heats valve members to prevent freezing and sticking with no significant contribution to the fluid. The heat conduction path is long and highly inefficent and no heat sensing or selective control is incorporated.

The patent to Miller discloses a device which is a mechanical selector of three preset levels of flow rate in combination with two levels of heat input. No continuous variability of flow rates is provided. Heating is accomplished in a series of unintegral chambers apart from the faucet to comprise the complete system, introducing response lag and mass losses of heat, and the device is mechanically complex using interlocking and depending on sequential functions.

The patent to Lowe discloses a water heating system which has connected components, achieving a measure of integration by extending a heat exchanger into a supply tank. A large reservoir of water is maintained at temperature thereby increasing losses. A recirculating loop is included and other augmenting devices are attached.

By way of contrast, the present invention is an apparatus for heating and controlling the flow rate of a fluid which includes a fluid inlet, an outlet associated therewith, a chamber interposed therebetween in operative communication therewith, a heating instrumentality in the chamber which is operatively oriented to condition the temperature of the fluid as it passes therethrough, a valve instrumentality in the flow path between the inlet and the outlet which is adapted to control the flow rate, and a single control instrumentality which by appropriate respective manipulations thereof separately controls both the temperature, when manipulated in one direction, and the flow rate when manipulated in another direction so that only a single fluid conduit is required in communication with the outlet device and heating of the local water need only occur when its use is required. Needless heating and storage of heated fluid has thus been avoided.

SUMMARY OF THE INVENTION

An object of the present invention is to provide a novel apparatus for heating a fluid in the vicinity of its intended usage site.

A further object of the invention is to provide an apparatus of the character described above which contemporaneously can control the flow rate of the fluid as it passes through an associated outlet.

An additional object of the invention is to provide an apparatus of the character described above which is extremely reliable and safe in use.

Another object of the invention is to provide an apparatus of the character described above which is configured to lend itself to mass production techniques.

A still further object of the invention is to provide an apparatus of the character described above including appropriate controls and safety features so that overheating cannot occur even during minimal flow rates.

A still additional object of the invention is to provide an apparatus of the character described above in which a single control instrumentality can, by appropriate respective manipulations thereof, alter respectively the fluid temperature and the flow rate.

The foregoing objects, as well as others, are achieved by the apparatus described in the text set out hereinbelow, when taken in conjunction with the accompanying drawing figures. There has been provided an apparatus for heating and controlling the flow rate of a fluid which includes an inlet, an outlet associated therewith, a chamber disposed therebetween, the chamber including a heating means responsive to external control so as to control the fluid temperature thereof, and a valve means disposed within the flow path defined by the inlet and the outlet. Means which control the flow rate through the valve means includes a manipulatable member which also can be used to enable or disable the temperature control so that by appropriate respective manipulative orientation of the control instrumentality, both the flow rate and the temperature of the fluid can be independently and respectively affected.

The invention can be seen as being in an apparatus for heating and controlling the flow rate of a fluid which includes a fluid inlet, a chamber in communication with the fluid inlet, and electric heating means in the chamber for heating the fluid. A fluid outlet is in communication with the chamber. The inlet, the chamber and the outlet form a flow path. Thermostat means for setting maximum temperature of the fluid is provided, the thermostat means including heat-responsive means positioned in vicinity of the flow path and responsive to heat therefrom and heating current passing means for supplying current to the heating means, the heating current passing means being responsive to and controlled by the heat-responsive means. Valve means are provided in the flow path. Flow rate control means and heating control means include a single control instrumentality arranged independently to respectively open and close the valve means and to enable and disable the heat-responsive means.

DETAILED DESCRIPTION OF THE PREFERRED EMBODIMENT

Figure 1:
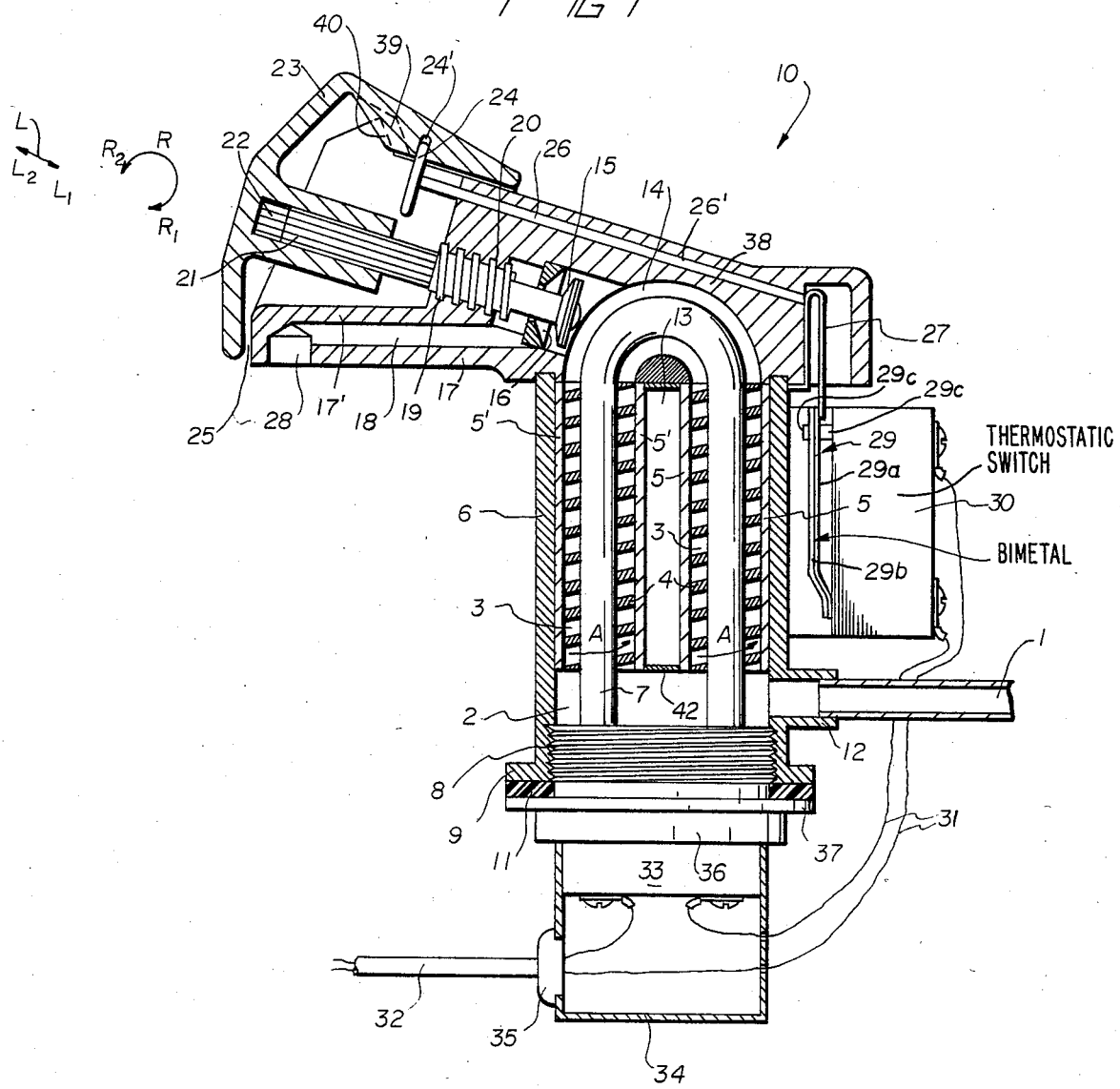
FIG. 1 is a cross-sectional view of an exemplary embodiment of an apparatus constructed in accordance with the present invention, its control mechanism being shown in a first state.

Referring to the drawings, wherein like reference numerals refer to like parts throughout, an apparatus for heating and controlling the flow rate of a fluid according to the present invention is designated generally by the numeral 10.

As shown, the apparatus 10 includes a fluid inlet 1, preferably formed from copper or PVC, slidably and frictionally disposed within a tubular extension 12 having an inner diameter corresponding to the outer diameter of the inlet 1. In a preferred form, water is carried within the inlet 1. The tubular extension 12 is formed as an integral part of a chamber, the chamber having a peripheral, cylindrical wall 6; however, other geometrical shapes for the wall are also possible. The chamber has an interior, generally designated by the numeral 2, which allows fluid communication of water from the inlet 1 into space within the chamber. Preferably two parallel and vertically extending tortuous paths 3 are arranged so that each of two fluid flow paths extend upwardly and in a spiral fashion about respective arms of an electrically energized heating element 7.

Respective outer annular walls 5 and 5' provided respectively about each of the two arms of the heating element 7 define respective outer boundaries of the respective toroidal tortuous paths 3 about the arms. Respective spiral baffles 4 are provided within each toroidal void, the baffles being in intimate thermal communication with its associated arm of the heating element 7 and constraining the fluid to also be in close thermal communication with these arms. Thus, liquid entering the inlet 1 traverses one of the two spiral paths about the two arms by hydraulic pressure upwardly as shown by the direction of the arrows A and extracts heat from the baffles 4, which are in contact with and in thermal communication with arms of heating element 7, and also directly from the heating element 7 by conduction as the liquid flows in direct contact with the surface of the arms of the heating element. The annular walls 5 and 5' serve to contain the heat within the toroid for maximum heat absorption by the fluid. A remaining chamber 13, defined by a volume outside of the two annular walls 5 and 5' and between the two arms of the heating element 7 has capped top and bottom ends, forms a void through which fluid cannot pass, constraining all flowing fluid to either one or the other of the two alternate heated paths 3, such void being suitably fashioned to minimize heat spots as well as heat sinks.

In practice in a preferred form the entire construction comprising the annular walls 5, 5' and the baffles 4 forming the two spiral paths 3 and the capped ends 41 and 42 blocking the chamber to flow outside of the annular walls 5 and 5' can be made of two segments of substantially the same half cylindrical shape and size which adjoin one another at the plane of the arms of the U-shaped heating element 7 and so complement and conform to one another that the assembly of the two segments form both the two continuous spiral flow paths 3 and the blocked volume to the full inner diameter of the chamber 2.

The fluid after having picked up the appropriate amount of heat from the heating element 7 is then directed onward through a dome-shaped passage 14 in the vicinity of the upmost portion of the heating element 7 and, thereafter, to an appropriate valve 15 to be described in more detail hereinbelow.

Disposed above the chamber wall 6 and fixed thereto is a handle support housing body 38, preferably pressed onto the chamber wall 6 and extending laterally outward, serving to support thereon a control knob 23 having plural degrees of freedom in order to provide plural controls respectively for the fluid flow rate and the temperature.

The body 38 has a lower lip 17 fixed to the upper edge of the chamber wall 6, the topmost portion of the lip 17 defining a fluid outlet conduit 18 when taken with other body structure as shown. An opening 28 is provided proximate to the lowermost portion of the knob 23 so that fluid will flow downwardly and outwardly therefrom. To this end, a web 17' is provided parallel to and spaced from the lip 17 so as to define the outlet conduit 18 and the opening 28.

The conduit 18 is in fluid communication with the dome-shaped chamber 14 by means of the valve 15 associated with a seat 16. The valve mechanism is in a preferred form, a poppet valve, its structure being described in more detail hereinbelow. A portion of the body 38 is provided with a helical thread 20, the thread 20 being adapted to complementally engage and conform to threads 19 on a poppet valve stem 21. In addition the valve stem 21 has on a periphery thereof along the longitudinal axis of the stem 21 shown to the left of the threads 19, a plurality of splines which are adapted to register with complementally formed splines 22 on the knob 23. Appropriate clearances are provided to allow suitable manipulation of the knob 23 in use and in operation. In any event, suitable rotation of knob 23 moves the helical threads 19, 20 relative to one another causing travel of the valve 15 in the direction of the longitudinal axis of the stem 21. When advanced from right to left, as shown in the drawings, the valve 15 is caused to nest against the appropriately dimensioned valve seat 16 so that at this one extreme, fluid flow is completely interrupted. In the other extreme, (to the right in the drawing figures) maximum flow rate is permissible, the valve seat 16 forming part of a passageway to allow fluid communication between the dome 14 and the outlet conduit 18, whenever the valve 15 is not seated on its seat 16.

The knob 23 heretofore mentioned is a preferred form of control member which could also be realized as a lever which would rotate about the valve stem 21, as does the knob 23 and also slide longitudinaly upon the splines 22 or, in yet another variant, engage a pivot pin through the valve stem 21 rather than the splines to allow a rocking motion in the plane of the drawings. In each arrangement a suitable mechanism would engage a heat control linkage. In the preferred form utilizing the knob 23 as shown, an upper portion of the body 38 is provided with an elongated bore 26' to allow the slidable disposition therein of a heat control rod 26. More specifically, a terminus of the heat control rod 26 proximate to the knob 23 is provided with a link member 24 which is transverse to the elongate extent of the rod 26. Thus, motion of the knob 23 along the length of the rod 26 causes motion of the rod in that direction. To this end, a groove 24' is disposed within the knob 23 on an inner surface thereof so that movement direction in either sense of the arrow L will result in corresponding axial translation of the rod 26. The terminus of the rod 26 remote from the transverse link member 24 is operatively connected to a linkage 27 preferably formed of resilient spring material that when released as shown in FIG. 1, resumes the configuration shown therein.

Figure 2:
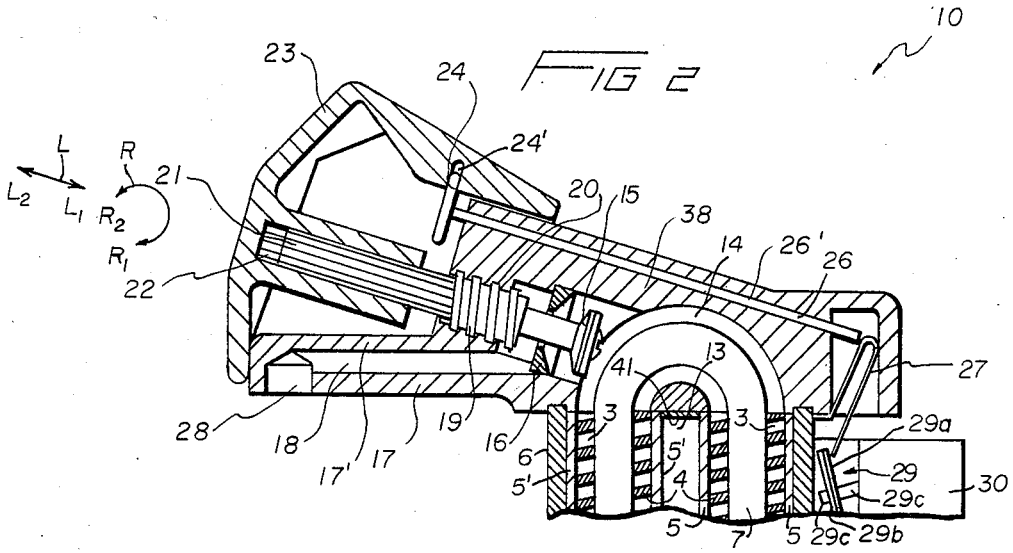
FIG. 2 is a cross-sectional view of a portion of the apparatus illustrated in FIG. 1 showing the control mechanism in a second state.

The heat-responsive means comprises a bimetallic member 29, which is a conventional bimetallic strip composed of metal members **29*a* and 29*b* having different coefficients of thermal expansion so that the strip, when subject to temperatures above a predetermined level, will bend in a leftward direction, as viewed in FIGS. 1 and 2, one end of the bimetallic member 29 being riveted to or otherwise conventionally fixed to a surface of a housing 30 within which heating-current-carrying contacts are present. The bimetallic strip 29 is provided near its upward end with a slit or slot (not visible) within which is fixed an operator 29*c* made of electrically insulating material. This operator 29*c* extends into the housing 30 and serves to selectively make and break heating current passing means comprising conventional heating-current-carrying contacts (not shown) within the housing. In the position shown in FIG. 1, the contacts would be made and current would be supplied to the heating element 7, via conductors 31. In the position shown in FIG. 2, the heating-current-carrying contacts would be open and current to the heating element 7 would be interrupted. The bimetallic member 29 and its associated housing 30, with the contacts and other components therein, are conventional components of conventional thermostats. One commercially available, conventional thermostat which could be used to provide the bimetallic member 29, its associated housing 30** and the components therein is available under the Factory Model Type WH2 identification designation from the Robertshaw Controls Co., Uni-Line Division, whose address is P.O. Box 2000, 4190 Temescal Street, Corona, Calif. 91720. It is to be appreciated that numerous other commercially available thermostats could be used as well. The above mentioned Factory Model Type WH2 thermostat is provided with a screw driver adjustment (not shown) which allows a user to set the temperature (from 110° F.

to 170° F.) at which the heating-current-carrying contacts make and break. As used in the present invention, the thermostat sets the maximum water temperature. When the link 27 is deflected, as shown in FIG. 2, a pivotal movement of the link 27 causes an associated displacement of a bimetallic member 29 from the position shown in FIG. 1 to that shown in FIG. 2.

Thus, in the preferred illustrated embodiment deflection of the bimetallic member 29 leftward, either as a result of achieving set water temperature or action of the linkage 27, causes the heating current supplied to the heating element 7 via the conductors 31, to be interrupted, either as a result of achieving desired water temperature or regardless of the temperature of the water, depending on which position a user has set the rod 26 by manipulating the knob 23. A clearance gap 25 is provided between the knob 23 and the web 17' as it extends to the outlet 28 so that the maximum distance of displacement of the rod 26 is fixed by the gap 25. In association therewith, a cam surface 39 in a preferred form located on the inner surface of knob 23 and integral with the knob, engages an integral projection 40, or alternatively a pin, on the upper portion of the body 38 at the extreme of rotation when the valve 15 is finally approaching and engaging the valve seat 16 so as to cause the knob 23 to shift laterally in axial direction $L_1$ to close the clearance gap 25 as rotation of the knob 23 continues and finally terminates at the closed condition of the valve. Such lateral shifting of the knob 23 acts also to shift the heating current control rod 26 and thereby causes the link 27 to be deflected to the configuration shown in FIG. 2, causing a related displacement to the left of the free end of the bimetallic member 29, interrupting the heating current to the heating element 7 as a result of the operator **29*c* opening current-carrying contacts within the housing 30. The foregoing relates the manner in which the apparatus interrupts power input to the heating element 7 and, in one mode, prevents overheating which might result at low or zero rates of flow, as determined by the position of valve 15. The bimetallic member 29 is mounted close to an outer surface of the chamber wall 6 and thus is in close thermal communication with the chamber surface by conduction through the chamber wall 6 and radiation and convection therefrom. This close thermal communication with the internal fluid whether static or flowing about the arms of the heating element 7 results in a setting of the maximum temperature thereof. In the manner of thermal switches, when a sufficiently elevated temperature is reached by the fluid, electrical power to the heating element 7 is interrrupted thus preventing overheating of the fluid when some malfunction occurs such as the loss of fluid pressure required to maintain flow. Since the bimetallic member 29 is contacted on only one side by the link 27, the free end of the bimetallic strip 29 can move to the left (the position of FIG. 2) when an overheat condition is sensed even though it has not been forcibly displaced to that position by action of the link 27**.

The heating control thermostat is shown as electrically communicating with the heating element 7 in an insulating base 33 via electrical terminals in the base and the insulated conductors 31, as shown in FIG. 1 to allow either full or zero current to be supplied to the heating element 7. The heating element 7 is provided with an annular flange member 37 for attachment to a corresponding flange 9 on the chamber wall 6. In addition, a gasket 11 is interposed therebetween to afford a tight seal, and the chamber wall 6 and a base 36 of the heating element 7 are complementally threaded with threads 8 so that the element can be replaced as an integral module either for replacement, or modification so as to provide heating capabilities for different throughputs. As shown in the drawings, the conductors 31 communicate with a power source through an electrical conduit 32 which extends without a housing 34 which forms a portion of the support for the heating element 7, the housing having a bottom closed capped portion to retard the ingress of moisture or other type of contaminates. To this end, a grommet 35 is provided proximate the orifice through which the conduit 32 extends.

In use and operation, a number of conditions can occur.

The knob 23 may be rotated in the direction $R_1$ to the maximum extent and the knob extended in the direction $L_2$ as shown in FIG. 1, resulting in maximum flow rate and application of heating current to the heating element 7 provided the water has not reached its desired temperature. When the desired temperature is reached, as sensed by the bimetallic member 29, it bends sufficiently leftward, regardless of the position of linkage 27, causing the heating current to be interrupted. Of course, if the temperature drops below the desired temperature, the bimetallic 29 member moves back to its passive position, and heating element 7 is again supplied with current.

As shown in FIG. 2 the knob 23 may be translated in a direction $L_1$ to its maximum extent and the knob 23 is in the direction of $R_1$ as shown in FIG. 2, resulting in maximum flow rate and interruption of heating current to the heating element 7 regardless of temperature because of action by the link 27.

When the face of valve 15 is, as it may be, in intimate contact with the seat 16, there can be no fluid flow. Link 27 must then be displaced by the knob 23 being pushed in the direction $L_1$ by action of cam 39 against projection 40; under these conditions, the heating element 7 is not supplied with heating current and is prevented from heating the water when there is zero flow rate.

In this manner, heating of the fluid cannot occur unless there is demand subtantially at that instant by a user who would pull the knob 23 in the axial direction $L_2$ allowing the bimetallic member 29 to assume the position shown in FIG. 1. Heating current would then flow until the heat causes the free end of bimetallic strip to bend to the left, regardless of lack of the force thereon by the link 27. Manipulation of the link 27 from one extreme to the other, as shown in the drawings, will correspondingly alter the amount of thermal energy directed into the chamber 2 and then the chamber wall 6 in accordance with the position of the link 27. In addition, rotation of the knob 23 between extremes will alter the flow rate correspondingly.

In view of the foregoing, there has been provided a device which requires a single inlet to provide liquid which is then conditioned both as to its flow rate and temperature before emerging at a single outlet opening.

Moreover, having thus described the invention, it should be appreciated that numerous other embodiments, variants and structural modifications are possible without departing from the spirit and scope of the invention, as defined by the claims.

What is claimed is:

1. An apparatus for heating and controlling the flow rate of a fluid comprising, in combination:

a fluid inlet;

a chamber in communication with said fluid inlet;

electric heating means in said chamber for heating the fluid;

a fluid outlet in communication with said chamber, said inlet, said chamber and said outlet forming a flow path;

thermostat means for setting maximum temperature of the fluid, said thermostat means including heat-responsive means positioned in vicinity of said flow path and responsive to heat therefrom and heating current passing means for supplying current to said heating means, said heating current passing means being responsive to and controlled by said heat responsive means;

valve means in said flow path for controlling the flow therethrough;

flow rate control means and heating control means including a single selectively manually operable control instrumentality arranged to respectively open and close said valve means and to enable and disable said heat responsive means.

2. The apparatus according to claim 1, wherein said heat responsive means comprises a bimetallic member.

3. The apparatus according to claim 2, including operator means carried by said bimetallic member and arranged to turn said heating current passing means on and off respectively depending on position of said bimetallic member.

4. The apparatus according to claim 3, including a housing body, and wherein said single control instrumentality includes a knob overlaying a portion of said housing body, which overlays said chamber, a groove disposed within a portion of said knob, linkage means including a transverse link seated within the groove, said transverse link extending within said knob and fastened to an elongate control rod disposed within a bore in said body, said rod being operatively coupled to a further link which is operatively arranged to disable said heat-responsive means regardless of the temperature to which it is subjected whenever said knob is in one position and to enable said heat-responsive means to respond whenever said knob is in another position.

5. The apparatus according to claim 4, wherein said flow rate control means includes a splined recessed portion in said knob adapted to rotate a similarly splined valve stem, said valve stem including a threaded portion coacting with complementally formed threads within an upper portion of said housing body, said valve means including a valve carried on said stem remote from said splined portion thereof.

6. The apparatus according to claim 5, wherein said valve means includes a valve seat disposed within upper portion of said housing body, a portion of said valve means further including said valve stem having at one end a valve seal adapted to nest within said valve seat whereby altering the distance between said valve seat and said valve seal upon appropriate rotation of said knob alters fluid flow.

7. The apparatus according to claim 6, wherein said chamber includes two tubular portions having a plurality of baffles therewithin, said electric heating means extending through said tubular portions and said baffles to define toroidal flow paths from said inlet toward said outlet, whereby the fluid is caused to traverse through said toroidal flow paths past said baffles in a tortuous fashion intimately contacting said electric heating means to provide thermal communication therewith.

8. The apparatus according to claim 7, wherein said linkage is operatively coupled to said heat-responsive means by said further link respectively to enable and to disable said heat responsive means in response to movement of said single control instrumentality.

9. The apparatus according to claim 8, wherein said electric heating means includes a threaded lower portion secured within said chamber, a gasket disposed on a bottom portion of said chamber for providing a liquid seal between said chamber and said lower portion, and wherein said heating means comprises a heating element in substantially an inverted U-shaped configuration having arms disposed through said toroidal flow paths.

10. The apparatus according to claim 9, wherein said housing body includes a lip extending from a topmost portion of said chamber and an associated web thereabove, a space therebetween defining said fluid outlet in fluid communication with said valve means, said fluid outlet terminating in an opening below said knob.

11. The apparatus according to claim 10, wherein a portion proximate to a topmost portion of said heating element is provided in said housing body upper portion defining as said chamber a domed chamber within which the fluid passes prior to transmission through said valve means.

12. The apparatus according to claim 11, wherein said heating current passing means is connected to said heating element by conductor means, said conductor means extending without the apparatus and being isolated by housing and plug means.

* * * * *